US008922596B2

(12) United States Patent
Liao et al.

(10) Patent No.: US 8,922,596 B2
(45) Date of Patent: Dec. 30, 2014

(54) LCD OVERDRIVING METHOD AND DEVICE AND LCD

(75) Inventors: Liang-chan Liao, Shenzhen (CN); Po-shen Lin, Shenzhen (CN); Xiaoping Tan, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 326 days.

(21) Appl. No.: 13/379,660

(22) PCT Filed: Sep. 19, 2011

(86) PCT No.: PCT/CN2011/079813

§ 371 (c)(1),
(2), (4) Date: Dec. 21, 2011

(87) PCT Pub. No.: WO2013/033928

PCT Pub. Date: Mar. 14, 2013

(65) Prior Publication Data

US 2013/0057568 A1 Mar. 7, 2013

(30) Foreign Application Priority Data

Sep. 6, 2011 (CN) ..... 2011 1 0262787

(51) Int. Cl.
*G09G 5/10* (2006.01)
*G09G 3/36* (2006.01)

(52) U.S. Cl.
CPC ..... *G09G 3/3648* (2013.01); *G09G 2320/0252* (2013.01); *G09G 2320/0285* (2013.01); *G09G 2340/16* (2013.01)
USPC ..... 345/690; 345/89; 345/204

(58) Field of Classification Search
CPC ..... G09G 2320/0252; G09G 2340/16
USPC ..... 345/204, 89, 690, 87, 96, 99, 100, 98
See application file for complete search history.

(56) References Cited

U.S. PATENT DOCUMENTS 8,049,691 B2 11/2011 Pan et al.
2003/0137527 A1 * 7/2003 Lin et al. ..... 345/698

(Continued)

FOREIGN PATENT DOCUMENTS

CN 101038732 A 9/2007
CN 101266760 A 9/2008

(Continued)

OTHER PUBLICATIONS

International Search Report of the PCT Application No. PCT/CN2011/079813.

(Continued)

*Primary Examiner* — Koosha Sharifi-Tafreshi

(57) ABSTRACT

A liquid crystal display (LCD) overdriving method, an LCD overdriving device and an LCD are disclosed. The LCD overdriving method improves displaying quality and a response speed of the LCD comprising the following steps of: receiving by a scaling controller, a previous frame image grayscale value stored into a frame buffer of the scaling controller; receiving a next frame image grayscale value by the scaling controller and sending the previous frame image grayscale value and the next frame image grayscale value to a time schedule controller so that the time schedule controller looks up a lookup table and outputs an overdriving grayscale value. The present disclosure can effectively save the cost by eliminating the need of providing an additional frame buffer in the time schedule controller. Furthermore, as image grayscale values of only two pixels need to be stored in the time schedule controller, it can save more memory spaces.

18 Claims, 4 Drawing Sheets

(56) References Cited

U.S. PATENT DOCUMENTS

| | | | | |
|---|---|---|---|---|
| 2005/0151712 | A1* | 7/2005 | Pai | 345/98 |
| 2006/0103682 | A1* | 5/2006 | Kunimori et al. | 345/690 |
| 2007/0115272 | A1* | 5/2007 | Huang | 345/204 |
| 2008/0224980 | A1* | 9/2008 | Senda et al. | 345/96 |
| 2008/0309687 | A1* | 12/2008 | Choi et al. | 345/698 |
| 2009/0040167 | A1* | 2/2009 | Sun | 345/99 |
| 2009/0174691 | A1* | 7/2009 | Yeo | 345/204 |

FOREIGN PATENT DOCUMENTS

| | | | |
|---|---|---|---|
| CN | 101359458 | A | 2/2009 |
| CN | 101556790 | A | 10/2009 |
| CN | 101847381 | A | 9/2010 |

OTHER PUBLICATIONS

1st Office Action of Chinese Patent Application No. 201110262787.5 issued by Chinese Patent Office.

* cited by examiner

| Overdriving grayscale value | | Next frame image grayscale value | | | | | | | | |
|---|---|---|---|---|---|---|---|---|---|---|
| | | a | b | c | d | e | f | g | h | i |
| Previous frame image grayscale value | a | aa | ab | ac | ad | ae | af | ag | ah | ai |
| | b | ba | bb | bc | bd | be | bf | bg | bh | bi |
| | c | ca | cb | cc | cd | ce | cf | cg | ch | ci |
| | d | da | db | dc | dd | de | df | dg | dh | di |
| | e | ea | eb | ec | ed | ee | ef | eg | eh | ei |
| | f | fa | fb | fc | fd | fe | ff | fg | fh | fi |
| | g | ga | gb | gc | gd | ge | gf | gg | gh | gi |
| | h | ha | hb | hc | hd | he | hf | hg | hh | hi |
| | i | ia | ib | ic | id | ie | if | ig | ih | ii |

LCD OVERDRIVING METHOD AND DEVICE AND LCD

BACKGROUND

1. Technical Field

The present disclosure relates to driving of liquid crystals, and more particularly, to a liquid crystal display (LCD) overdriving method, an LCD overdriving device, and an LCD.

2. Description of Related Art

How to shorten the response time of liquid crystals in driving of liquid crystal displays (LCDs) has always been a challenge in the LCD industry. Particularly in presentation of a dynamic image, smearing of the dynamic image will have a serious influence on quality of the image displayed. For example, when the image changes from a previous frame to a next frame, the grayscale value of the image may increase; however, because of the low response speed of liquid crystals, it requires a relatively long time for the grayscale value of the image to reach the expected luminance of the next frame. In order to increase the response speed of the liquid crystals, a practice that is the most commonly used at present is to adopt overdriving; that is, by correcting a grayscale value of the next frame, a corresponding overdriving grayscale value is obtained and then converted into an increased driving voltage to increase a voltage difference across the liquid crystals. In this way, the response speed of the liquid crystals can be increased to shorten the response time thereof.

In a conventional LCD overdriving method, pixel grayscale values of the previous frame are stored in a time schedule controller and pixel grayscale values of the next frame are stored in a scaling controller. Because of the large scale of the pixel data, an additional frame buffer has to be provided between the time schedule controller and the scaling controller to store a whole frame, which considerably increases the area of the printed circuit board (PCB). Furthermore, when the number of pixels increases, the memory space that is needed shall be increased correspondingly. This imposes higher requirements on capacity of the frame buffer and, therefore, leads to a higher cost.

BRIEF SUMMARY OF

A primary objective of the present disclosure is to provide an LCD overdriving method, an LCD overdriving device and an LCD that are capable of saving the memory space and lowing the cost.

The present disclosure provides an LCD overdriving method for improving displaying quality and a response speed of an LCD, comprising the following steps of:

receiving, by a scaling controller, a previous frame image grayscale value and storing the previous frame image grayscale value into a frame buffer of the scaling controller; and receiving a next frame image grayscale value by the scaling controller and sending the previous frame image grayscale value and the next frame image grayscale value to a time schedule controller so that the time schedule controller looks up a lookup table and outputs an overdriving grayscale value.

Preferably, the step that the time schedule controller looks up a lookup table and outputs an overdriving grayscale value further comprises the following steps of:

receiving the previous frame image grayscale value and the next frame image grayscale value sent by the scaling controller;

looking up the lookup table to obtain an overdriving grayscale value corresponding to the previous frame image grayscale value and the next frame image grayscale value; and outputting the overdriving grayscale value to a digital-to-analog (D/A) converter so that the D/A converter converts the overdriving grayscale value into an overdriving voltage.

Preferably, the step that the D/A converter converts the overdriving grayscale value into an overdriving voltage further comprises the following steps of:

converting the overdriving grayscale value into the overdriving voltage through D/A conversion; and outputting the overdriving voltage to an LCD panel to drive liquid crystals in the LCD panel to make a response.

Preferably, sending the previous frame image grayscale value and the next frame image grayscale value to the time schedule controller by the scaling controller is accomplished through an LVDS data interface disposed between the scaling controller and the time schedule controller.

The present disclosure further provides an LCD overdriving device, comprising:

a scaling controller, being configured to receive a previous frame image grayscale value and a next frame image grayscale value;

a frame buffer, being configured to store the previous frame image grayscale value; and a time schedule controller, being configured to receive the previous frame image grayscale value and the next frame image grayscale value sent by the scaling controller, look up a lookup table and output an overdriving grayscale value.

Preferably, the time schedule controller comprises:

a grayscale value receiving module, being configured to receive the previous frame image grayscale value and the next frame image grayscale value sent by the scaling controller; and a lookup table looking-up module, being configured to look up the lookup table to output an overdriving grayscale value corresponding to the previous frame image grayscale value and the next frame image grayscale value.

Preferably, the LCD overdriving device further comprises:

a D/A converter, being configured to receive the overdriving grayscale value sent by the time schedule controller and convert the overdriving grayscale value into an overdriving voltage.

Preferably, the D/A converter comprises:

an overdriving voltage converting module, being configured to convert the overdriving grayscale value into the overdriving voltage through D/A conversion; and an overdriving voltage output module, being configured to output the overdriving voltage to an LCD panel to drive liquid crystals in the LCD panel to make a response.

Preferably, receiving the previous frame image grayscale value and the next frame image grayscale value by the time schedule controller is accomplished through an LVDS data interface disposed between the scaling controller and the time schedule controller.

Preferably, the lookup table is built in the time schedule controller.

Preferably, the lookup table is disposed outside the LCD overdriving device.

The present disclosure further comprises an LCD comprising an LCD panel, further comprising:

an overdriving device, being configured to receive an image grayscale value and output an overdriving voltage to the LCD panel.

According to the present disclosure, the previous frame image grayscale value is stored in the frame buffer instead of in the time schedule controller. This can effectively save the cost by eliminating the need of providing an additional frame buffer in the time schedule controller. Furthermore, as image grayscale values of only two pixels need to be stored in the time schedule controller, the problem of insufficient memory space due to an increased amount of pixel data is avoided and the memory space of the time schedule controller is saved.

Hereinafter, implementations, functional features and advantages of the present disclosure will be further described with reference to embodiments thereof and the attached drawings.

DETAILED DESCRIPTION OF THE DISCLOSURE

It shall be understood that, the embodiments described herein are only intended to illustrate but not to limit the present disclosure.

Figure 1:
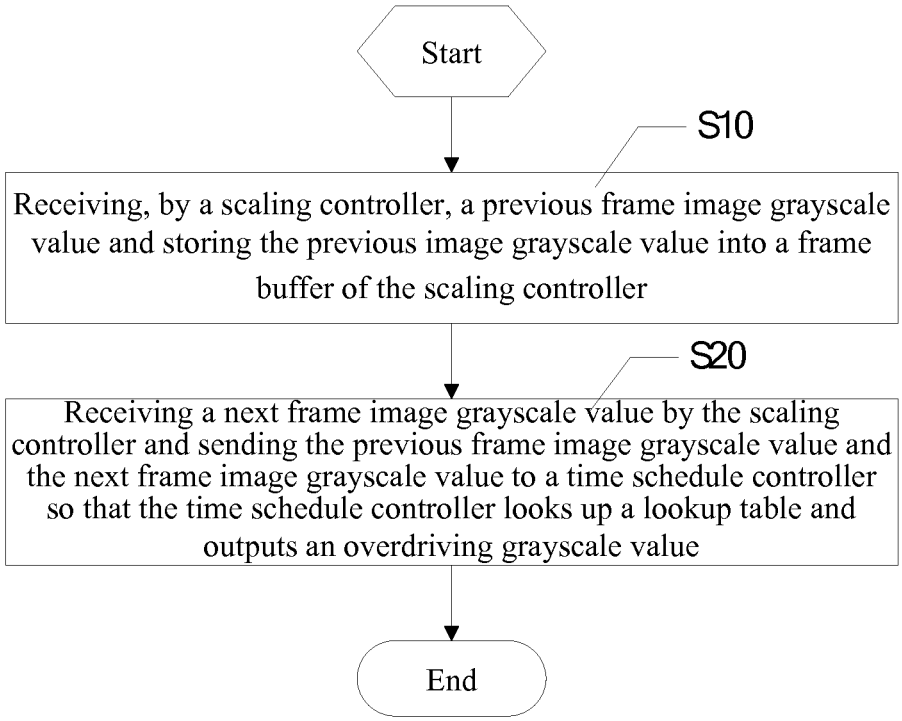
FIG. 1 is a flowchart diagram of an LCD overdriving method according to the present disclosure.

Referring to FIG. 1, there is shown a flowchart diagram of an LCD overdriving method according to the present disclosure. The LCD overdriving method is used to improve the displaying quality and the response speed of an LCD, and comprises the following steps.

Step S10: receiving, by a scaling controller, a previous frame image grayscale value and storing the previous image grayscale value into a frame buffer of the scaling controller.

In this embodiment, pixel data of the previous frame is stored in the frame buffer of the scaling controller instead of the time schedule controller. This eliminates the need of providing an additional frame buffer in the time schedule controller and significantly saves the memory space in the time schedule controller.

Step S20: receiving a next frame image grayscale value by the scaling controller and sending the previous frame image grayscale value and the next frame image grayscale value to a time schedule controller so that the time schedule controller looks up a lookup table and outputs an overdriving grayscale value.

In this embodiment, the image grayscale values are transmitted in units of one pixel. When the grayscale value of one pixel of the next frame arrives in the scaling controller, the scaling controller retrieves from the frame buffer the grayscale value of a corresponding pixel in the previous frame and sends the grayscale values of the previous frame and the next frame to the time schedule controller. In this case, image grayscale values of only two pixels need to be stored in the time schedule controller, so it is unnecessary to provide an additional frame buffer in the time schedule controller, thus saving the cost. Meanwhile, once outputting of the overdriving grayscale value is completed, the time schedule controller releases the image grayscale values in the memory space so as to receive image grayscale values corresponding to a next pixel in the previous frame and the next frame. In this way, the problem of insufficient memory space when pixel data of a whole frame has to be stored is avoided and the memory space of the time schedule controller is saved.

Figures 2, 3:
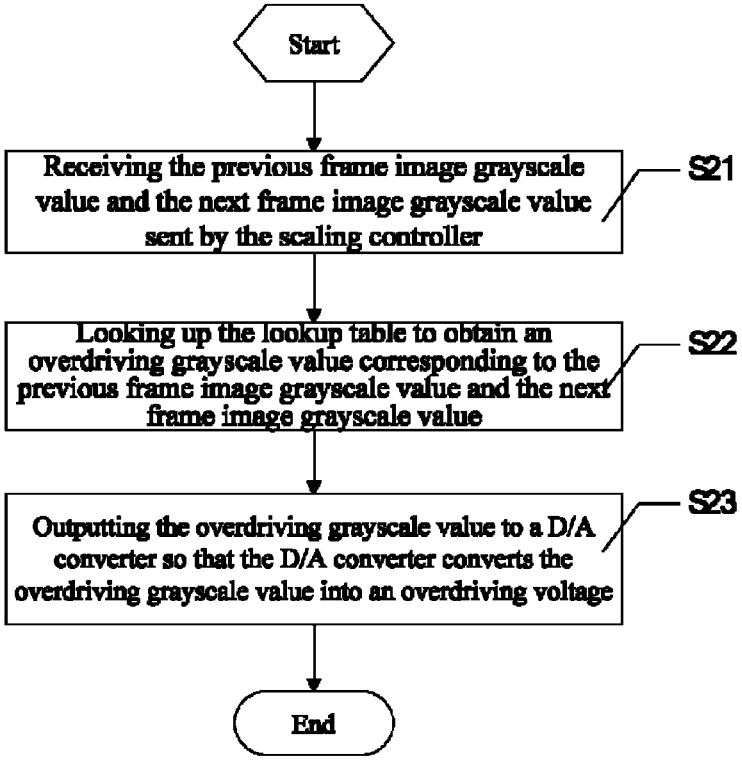
FIG. 2 is a flowchart diagram illustrating steps of outputting an overdriving grayscale value by a time schedule controller in the LCD overdriving method according to the present disclosure.
FIG. 3 is a schematic view of a lookup table used in the LCD overdriving method according to the present disclosure.

Referring to FIG. 2, there is shown a flowchart diagram illustrating steps of outputting an overdriving grayscale value by a time schedule controller in the LCD overdriving method according to the present disclosure. In the step S20 described above, the step that the time schedule controller looks up a lookup table and outputs an overdriving grayscale value further comprises the following steps.

Step S21: receiving the previous frame image grayscale value and the next frame image grayscale value sent by the scaling controller.

In this embodiment, transmission of the previous frame image grayscale value and the next frame image grayscale value is accomplished through an LVDS data interface between the scaling controller and the time schedule controller. The image grayscale values are transmitted in units of one pixel, and grayscales corresponding to a same pixel location in a previous frame and a next frame are transmitted at a time, so the time schedule controller only needs to store grayscales of two pixels at a time. This saves the memory space of the time schedule controller.

Step S22: looking up the lookup table to obtain an overdriving grayscale value corresponding to the previous frame image grayscale value and the next frame image grayscale value.

In this embodiment, the overdriving grayscale value is obtained by enabling the time schedule controller to look up the lookup table built in the time schedule controller (the lookup table may also be disposed in a memory external to the LCD overdriving device). In the lookup table, the previous frame image grayscale value and the next frame image grayscale value of a same pixel location correspond to one overdriving grayscale value.

Step S23: outputting the overdriving grayscale value to a digital-to-analog (D/A) converter so that the D/A converter converts the overdriving grayscale value into an overdriving voltage.

In this embodiment, the overdriving image grayscale value in a digital form is converted by the D/A converter into an overdriving voltage in an analog form, which is then applied across the liquid crystals. As the overdriving voltage is higher than the original driving voltage, the response speed of the liquid crystals gets increased and the response time of the liquid crystals is shortened.

Referring to FIG. 3, there is shown a schematic view of a lookup table used in the LCD overdriving method according to the present disclosure.

In the lookup table of this embodiment, the first column of values are previous frame image grayscale values, the first row of values are next frame image grayscale values, and other values are overdriving grayscale values. When a previous frame image grayscale value is identical to a next frame image grayscale value, the overdriving grayscale value outputted is also identical to both the first frame image grayscale value and the next frame image grayscale value; and when the previous frame image grayscale value is different from the next frame image grayscale value, the overdriving grayscale value is just a value corresponding to the row where the previous frame image grayscale value is located and the column where the next frame image grayscale value is located in the lookup table. For example, if the previous frame image grayscale value is c and the next frame image grayscale value is d, then a value cd located in the $c^{th}$ row and the $d^{th}$ column is just the corresponding overdriving grayscale value. Then, the value cd is outputted to the D/A converter to be converted into an overdriving voltage. In this way, the magnitude of the driving voltage is altered to shorten the response time of the liquid crystals and improve displaying quality of the LCD.

Figure 4:
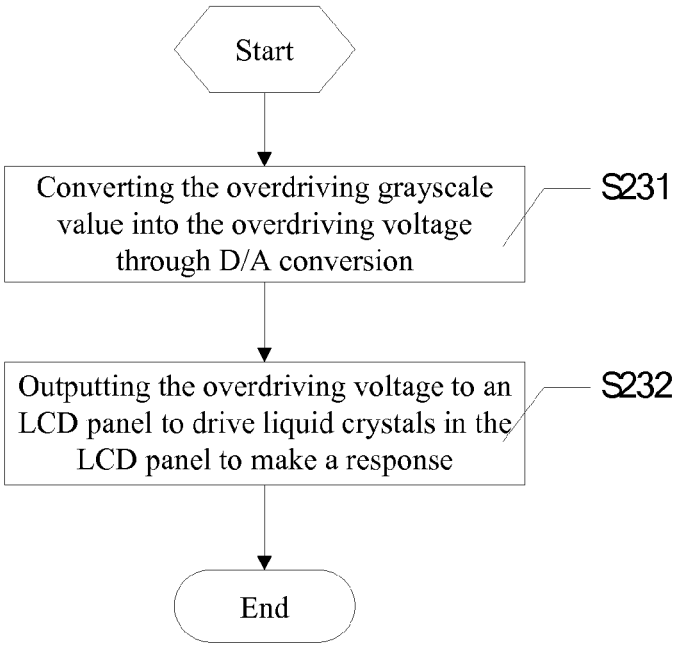
FIG. 4 is a flowchart diagram illustrating steps of outputting an overdriving voltage by a D/A converter in the LCD overdriving method according to the present disclosure.

Referring to FIG. 4, there is shown a flowchart diagram illustrating steps of outputting an overdriving voltage by a D/A converter in the LCD overdriving method according to the present disclosure. As shown in FIG. 4, in the step S23 described above, the process in which the D/A converter converts the overdriving grayscale value into an overdriving voltage further comprises the following steps.

Step S231: converting the overdriving grayscale value into the overdriving voltage through D/A conversion; and Step S232: outputting the overdriving voltage to an LCD panel to drive liquid crystals in the LCD panel to make a response.

In this embodiment, the overdriving image grayscale value in a digital form is converted by the D/A converter into an overdriving voltage in an analog form, which is then applied across the liquid crystals. As the overdriving voltage is higher than the original driving voltage, the response speed of the liquid crystals gets increased and the response time of the liquid crystals is shortened.

Figure 5:
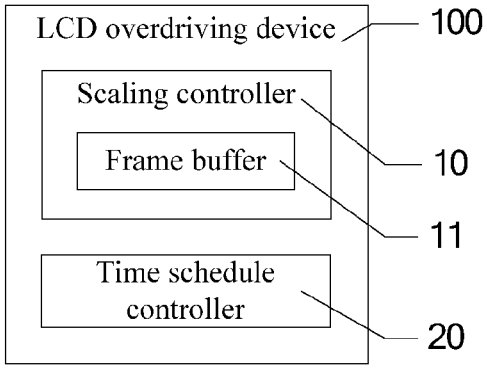
FIG. 5 is a schematic structural view of an LCD overdriving device according to the present disclosure.
Figure 6:
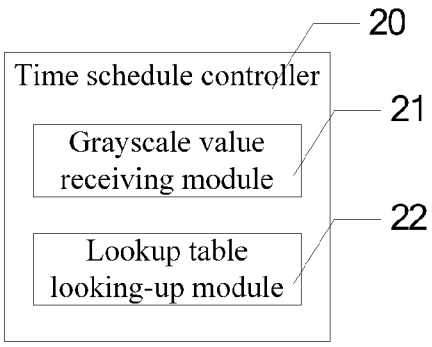
FIG. 6 is a schematic structural view of a time schedule controller in the LCD overdriving device according to the present disclosure.
Figure 7:
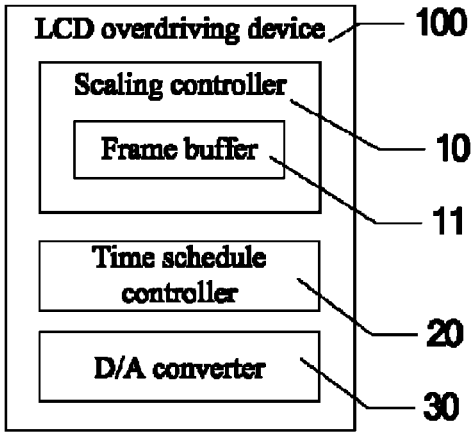
FIG. 7 is a schematic structural view of the LCD overdriving device (comprising a D/A converter) according to the present disclosure.
Figure 8:
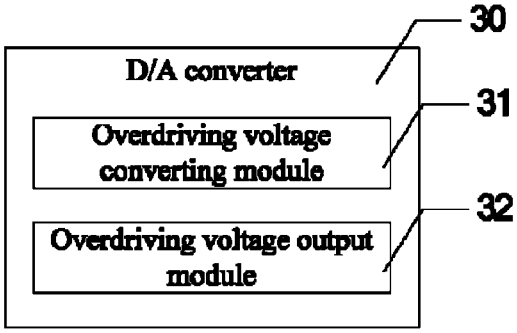
FIG. 8 is a schematic structural view of the D/A converter in the LCD overdriving device according to the present disclosure.

Referring to FIGS. 5 to 8, FIG. 5 is a schematic structural view of an LCD overdriving device according to the present disclosure; FIG. 6 is a schematic structural view of a time schedule controller in the LCD overdriving device according to the present disclosure; FIG. 7 is a schematic structural view of the LCD overdriving device (comprising a D/A converter) according to the present disclosure; and FIG. 8 is a schematic structural view of the D/A converter in the LCD overdriving device according to the present disclosure.

As shown in FIG. 5, an LCD overdriving device 100 according to the present disclosure comprises:

a scaling controller 10, being configured to receive a previous frame image grayscale value and a next frame image grayscale value;

a frame buffer 11, being configured to store the previous frame image grayscale value; and a time schedule controller 20, being configured to receive the previous frame image grayscale value and the next frame image grayscale value sent by the scaling controller 10, look up a lookup table and output the overdriving grayscale value.

In this embodiment, the frame buffer 11 is disposed in the scaling controller 10, and the scaling controller 10 receives pixel data of the previous frame and stores it into the frame buffer 11. This eliminates the need of providing an additional frame buffer in the time schedule controller 20 and significantly saves the memory space in the time schedule controller 20. Furthermore, the image grayscale values are transmitted in units of one pixel. When the grayscale value of one pixel of the next frame arrives in the scaling controller 10, the scaling controller 10 retrieves from the frame buffer 11 the grayscale value of a corresponding pixel in the previous frame and sends the grayscale values of the previous frame and the next frame to the time schedule controller 20. In this case, image grayscale values of only two pixels need to be stored in the time schedule controller 20, so it is unnecessary to provide an additional frame buffer in the time schedule controller 20, thus significantly saving the cost. Meanwhile, once outputting of the overdriving grayscale value is completed, the time schedule controller 20 releases the image grayscale values in the memory space so as to receive image grayscale values corresponding to a next pixel in the previous frame and the next frame. In this way, the problem of insufficient memory space when pixel data of a whole frame has to be stored is avoided and the memory space of the time schedule controller 20 is saved.

As shown in FIG. 6, the time schedule controller 20 comprises:

a grayscale value receiving module 21, being configured to receive the previous frame image grayscale value and the next frame image grayscale value sent by the scaling controller 10; and a lookup table looking-up module 22 for looking up the lookup table to output an overdriving grayscale value corresponding to the previous frame image grayscale value and the next frame image grayscale value.

In this embodiment, an LVDS data interface is disposed between the scaling controller 10 and the time schedule controller 20 to accomplish transmission of the previous frame image grayscale value and the next frame image grayscale value. The image grayscale values are transmitted in units of one pixel, and only grayscales of a same pixel location in a previous frame and a next frame are transmitted at a time, so the time schedule controller 20 only needs to store grayscales of two pixels at a time. This saves the memory space of the time schedule controller 20. The overdriving grayscale value is obtained by the lookup table looking-up module 22 through accessing an external lookup table or a lookup table built in the time schedule controller 20. In the lookup table, the previous frame image grayscale value and the next frame image grayscale value of a same pixel location correspond to one overdriving grayscale value.

As shown in FIG. 7, the LCD overdriving device 100 further comprises:

a D/A converter 30, being configured to receive the overdriving grayscale value sent by the time schedule controller 20 and convert the overdriving grayscale value into an overdriving voltage.

In this embodiment, the overdriving image grayscale value in a digital form is converted into an overdriving voltage in an analog form, which is then applied across the liquid crystals. As the overdriving voltage is higher than the original driving voltage, the response speed of the liquid crystals gets increased and the response time of the liquid crystals is shortened.

As shown in FIG. 8, the D/A converter 30 comprises:

an overdriving voltage converting module 31, being configured to convert the overdriving grayscale value into the overdriving voltage through D/A conversion; and an overdriving voltage output module 32, being configured to output the overdriving voltage to an LCD panel to drive liquid crystals in the LCD panel to make a response.

In this embodiment, the overdriving image grayscale value in a digital form is converted by the overdriving voltage converting module 31 into an overdriving voltage in an analog form, which is then applied by the overdriving voltage output module 32 across the liquid crystals. As the overdriving voltage is higher than the original driving voltage, the response speed of the liquid crystals gets increased and the response time of the liquid crystals is shortened.

In this embodiment, the pixel data of the previous frame image grayscale values is stored in the frame buffer 11 instead of in the time schedule controller 20. This eliminates the need of providing an additional frame buffer in the time schedule controller 20 and can significantly save the memory space in the time schedule controller 20. Furthermore, when the grayscale value of one pixel of the next frame arrives in the scaling controller 10, the scaling controller 10 sends the grayscale values of the previous frame and the next frame to the time schedule controller 20. In this case, image grayscale values of only two pixels need to be stored in the time schedule controller 20, so it is unnecessary to provide an additional frame buffer in the time schedule controller 20, thus saving the cost. Meanwhile, once outputting of the overdriving grayscale value is completed, the time schedule controller 20 releases the image grayscale values in the memory space so as to receive image grayscale values corresponding to a next pixel in the previous frame and the next frame. In this way, the problem of insufficient memory space when pixel data of a whole frame has to be stored is avoided and the memory space of the time schedule controller 20 is saved.

Figure 9:
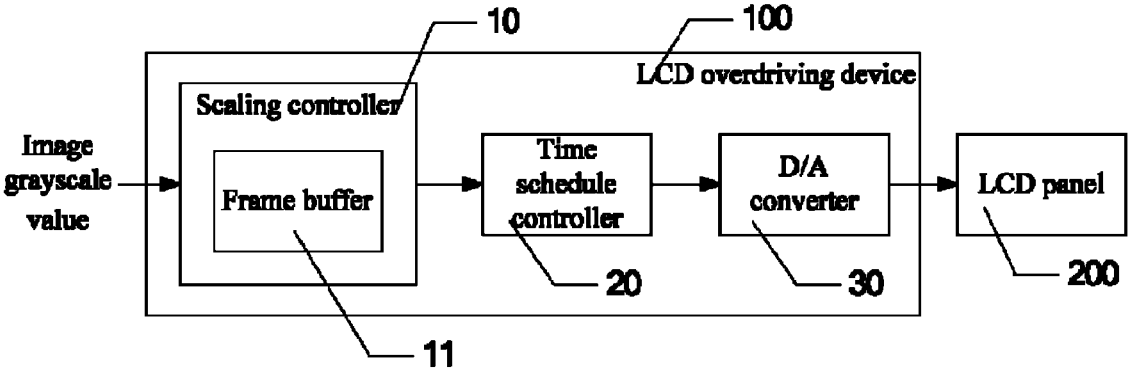
FIG. 9 is a schematic structural view of an LCD (comprising an overdriving device and an LCD panel) according to the present disclosure.

Referring to FIG. 9, there is shown a schematic structural view of an LCD (comprising an overdriving device and an LCD panel) according to the present disclosure. As shown in FIG. 9, the LCD of this embodiment comprises an overdriving device 100, which is configured to receive an image grayscale value and output an overdriving voltage to an LCD panel 200.

The overdriving device 100 comprises a scaling controller 10, a frame buffer 11 of the scaling controller 10, a time schedule controller 20 and a D/A converter 30. The scaling controller 10 is configured to receive a previous frame image grayscale value and store it into the frame buffer 11 of the scaling controller 10. The scaling controller 10 is further configured to receive a next frame image grayscale value and, through an LVDS data interface, send the previous frame image grayscale value and the next frame image grayscale value to the time schedule controller 20. The time schedule controller 20 is configured to obtain an overdriving grayscale value by looking up the lookup table and output the overdriving grayscale value to the D/A converter 30. The D/A converter 30 is configured to convert the overdriving grayscale value into an overdriving voltage for output to the LCD panel 200.

In this embodiment, the pixel data of the previous frame image grayscale values is stored in the frame buffer 11 instead of in the time schedule controller 20. This eliminates the need of providing an additional frame buffer in the time schedule controller 20 and can significantly save the memory space in the time schedule controller 20. Furthermore, when the grayscale value of one pixel of the next frame arrives in the scaling controller 10, the scaling controller 10 sends the grayscale values of the previous frame and the next frame to the time schedule controller 20. In this case, image grayscale values of only two pixels need to be stored in the time schedule controller 20, so it is unnecessary to provide an additional frame buffer in the time schedule controller 20, thus saving the cost. Meanwhile, once outputting of the overdriving grayscale value is completed, the time schedule controller 20 releases the image grayscale values in the memory space so as to receive image grayscale values corresponding to a next pixel in the previous frame and the next frame. In this way, the problem of insufficient memory space when pixel data of a whole frame has to be stored is avoided and the memory space of the time schedule controller 20 is saved.

What described above are only preferred embodiments of the present disclosure but are not intended to limit the scope of the present disclosure. Accordingly, any equivalent structural or process flow modifications that are made on basis of the specification and the attached drawings or any direct or indirect applications in other technical fields shall also fall within the scope of the present disclosure.

The invention claimed is:

1. A liquid crystal display (LCD) overdriving method for improving displaying quality and a response speed of an LCD, comprising the following steps of:

receiving, by a scaling controller, a previous frame image grayscale value and storing the previous frame image grayscale value into a frame buffer of the scaling controller; and receiving a next frame image grayscale value by the scaling controller and sending the previous frame image grayscale value and the next frame image grayscale value to a time schedule controller independent from the scaling controller so that the time schedule controller looks up a lookup table and outputs an overdriving grayscale value;

wherein the previous frame image grayscale value and the next frame image grayscale value are sent to the time schedule controller pixel by pixel, when outputting of a overdriving grayscale value of a pixel is completed, the previous frame image grayscale value and the next frame image grayscale value of the pixel are removed from a memory space of the time schedule controller and then a previous frame image grayscale value and a next frame image grayscale value of a next pixel are stored in the memory space.

2. The LCD overdriving method of claim 1, wherein the step that the time schedule controller looks up a lookup table and outputs an overdriving grayscale value further comprises the following steps of:

receiving the previous frame image grayscale value and the next frame image grayscale value sent by the scaling controller;

looking up the lookup table to obtain an overdriving grayscale value corresponding to the previous frame image grayscale value and the next frame image grayscale value; and outputting the overdriving grayscale value to a digital-to-analog (D/A) converter so that the D/A converter converts the overdriving grayscale value into an overdriving voltage.

3. The LCD overdriving method of claim 2, wherein the step that the D/A converter converts the overdriving grayscale value into an overdriving voltage further comprises the following steps of:

converting the overdriving grayscale value into the overdriving voltage through D/A conversion; and outputting the overdriving voltage to an LCD panel to drive liquid crystals in the LCD panel to make a response.

4. The LCD overdriving method of claim 1, wherein sending the previous frame image grayscale value and the next frame image grayscale value to the time schedule controller by the scaling controller is accomplished through an LVDS data interface disposed between the scaling controller and the time schedule controller.

5. An LCD overdriving device, comprising:

a scaling controller, being configured to receive a previous frame image grayscale value and a next frame image grayscale value;

a frame buffer, being configured to store the previous frame image grayscale value; and a time schedule controller independent from the scaling controller, being configured to receive the previous frame image grayscale value and the next frame image grayscale value sent by the scaling controller, look up a lookup table and output an overdriving grayscale value;

wherein the previous frame image grayscale value and the next frame image grayscale value are sent to the time schedule controller pixel by pixel, when outputting of a overdriving grayscale value of a pixel is completed, the previous frame image grayscale value and the next frame image grayscale value of the pixel are removed from a memory space of the time schedule controller and then a previous frame image grayscale value and a next frame image grayscale value of a next pixel are stored in the memory space.

6. The LCD overdriving device of claim 5, wherein the time schedule controller comprises:

a grayscale value receiving module, being configured to receive the previous frame image grayscale value and the next frame image grayscale value sent by the scaling controller; and a lookup table looking-up module, being configured to look up the lookup table to output an overdriving grayscale value corresponding to the previous frame image grayscale value and the next frame image grayscale value.

7. The LCD overdriving device of claim 5, further comprising:

a D/A converter, being configured to receive the overdriving grayscale value sent by the time schedule controller and convert the overdriving grayscale value into an overdriving voltage.

8. The LCD overdriving device of claim 7, wherein the D/A converter comprises:

an overdriving voltage converting module, being configured to convert the overdriving grayscale value into the overdriving voltage through D/A conversion; and an overdriving voltage output module, being configured to output the overdriving voltage to an LCD panel to drive liquid crystals in the LCD panel to make a response.

9. The LCD overdriving device of claim 5, wherein receiving the previous frame image grayscale value and the next frame image grayscale value by the time schedule controller is accomplished through an LVDS data interface disposed between the scaling controller and the time schedule controller.

10. The LCD overdriving device of claim 5, wherein the lookup table is built in the time schedule controller.

11. The LCD overdriving device of claim 5, wherein the lookup table is disposed outside the LCD overdriving device.

12. An LCD comprising an LCD panel and an overdriving device, being configured to receive an image grayscale value and output an overdriving voltage to the LCD panel, the overdriving device comprising:

a scaling controller, being configured to receive a previous frame image grayscale value and a next frame image grayscale value;

a frame buffer, being configured to store the previous frame image grayscale value; and a time schedule controller independent from the scaling controller, being configured to receive the previous frame image grayscale value and the next frame image grayscale value sent by the scaling controller, look up a lookup table and output an overdriving grayscale value;

wherein the previous frame image grayscale value and the next frame image grayscale value are sent to the time schedule controller pixel by pixel, when outputting of a overdriving grayscale value of a pixel is completed, the previous frame image grayscale value and the next frame image grayscale value of the pixel are removed from a memory space of the time schedule controller and then a previous frame image grayscale value and a next frame image grayscale value of a next pixel are stored in the memory space.

13. The LCD of claim 12, wherein the time schedule controller comprises:

a grayscale value receiving module, being configured to receive the previous frame image grayscale value and the next frame image grayscale value sent by the scaling controller; and a lookup table looking-up module, being configured to look up the lookup table to output an overdriving grayscale value corresponding to the previous frame image grayscale value and the next frame image grayscale value.

14. The LCD of claim 12, further comprising:

a D/A converter, being configured to receive the overdriving grayscale value sent by the time schedule controller and convert the overdriving grayscale value into an overdriving voltage.

15. The LCD of claim 14, wherein the D/A converter comprises:

an overdriving voltage converting module, being configured to convert the overdriving grayscale value into the overdriving voltage through D/A conversion; and an overdriving voltage output module, being configured to output the overdriving voltage to an LCD panel to drive liquid crystals in the LCD panel to make a response.

16. The LCD of claim 12, wherein receiving the previous frame image grayscale value and the next frame image grayscale value by the time schedule controller is accomplished through an LVDS data interface disposed between the scaling controller and the time schedule controller.

17. The LCD of claim 12, wherein the lookup table is built in the time schedule controller.

18. The LCD of claim 12, wherein the lookup table is disposed outside the LCD overdriving device.

* * * * *